US011497241B1

(12) United States Patent
Bavar et al.

(10) Patent No.: US 11,497,241 B1
(45) **Date of Patent: *Nov. 15, 2022**

(54) ASSEMBLY AND INSERT FOR EVENLY HEATING A SMOKABLE SUBSTANCE

(71) Applicant: Kaloud, Inc., Los Angeles, CA (US)

(72) Inventors: Reza Bavar, Los Angeles, CA (US); George Petropoulos, Patras (GR)

(73) Assignee: Kaloud, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/525,201

(22) Filed: Nov. 12, 2021

Related U.S. Application Data

(63) Continuation-in-part of application No. 17/503,963, filed on Oct. 18, 2021, which is a continuation-in-part of application No. 29/799,598, filed on Jul. 15, 2021.

(51) Int. Cl.
*A24F 1/30* (2006.01)
*A24F 5/00* (2006.01)

(52) U.S. Cl.
CPC . *A24F 5/00* (2013.01); *A24F 1/30* (2013.01)

(58) Field of Classification Search
USPC ..... 131/173
See application file for complete search history.

(56) References Cited

U.S. PATENT DOCUMENTS

| | | | | |
|---|---|---|---|---|
| 7,896,617 | B1 * | 3/2011 | Morando | F04D 7/065 416/182 |
| 10,021,907 | B2 | 7/2018 | Bavar | |
| 10,383,363 | B2 | 8/2019 | Bavar | |
| 2016/0143352 | A1 | 5/2016 | Bavar | |
| 2016/0348684 | A1 * | 12/2016 | Kuhns | F04D 29/441 |
| 2021/0123378 | A1 * | 4/2021 | Nichols et al. | F02C 7/264 |

OTHER PUBLICATIONS

Joe Perin, "How to Get Huge Clouds with your Kaloud Vitria Bowl" Internet article, www.hookah-shisha.com, May 2016, printed from the Internet on Jan./Feb. 2022. (Year: 2016).*

* cited by examiner

*Primary Examiner* — Dionne W. Mayes
(74) *Attorney, Agent, or Firm* — Myers Wolin, LLC

(57) ABSTRACT

Assemblies and inserts are provided for evenly heating a smokable substance. A hookah bowl insert is provided for heating a smokable substance. The insert has a central core having at least one passageway extending therethrough. The insert further has a plurality of radial extensions extending in a radial direction from the central core. The radial extensions may be for gripping the smokable substance therebetween, and each radial extension has a vertical extension extending in a direction perpendicular to the radial direction. The insert is formed from a heat conductive material, such that heat is distributed across the insert, and within the individual radial and vertical extensions. Each vertical extension has a thickness larger than a thickness of the insert at the central core. As such, the vertical extensions can maintain stable temperatures and transfer heat to and from the smokable substance located therebetween.

20 Claims, 16 Drawing Sheets

ASSEMBLY AND INSERT FOR EVENLY HEATING A SMOKABLE SUBSTANCE

CROSS REFERENCE TO RELATED APPLICATIONS

This application is a continuation in part of U.S. patent application Ser. No. 17/503,963, filed Oct. 18, 2021, which is a continuation in part of U.S. Des. Pat. application No. 29/799,598, filed Jul. 15, 2021, the entire contents of which are incorporated by reference herein.

FIELD OF THE INVENTION

The invention relates generally to assemblies and devices for preparing and retaining a smokable substance, such as tobacco, certain gels and liquids, or other organic and inorganic matter, for smoking using a water pipe, such as a hookah. The invention relates specifically to such assemblies and devices for evenly heating the smokable substance.

BACKGROUND

Traditional hookahs include a liquid container, a smoke source, and a hollow pipe extending from the smoke source into the liquid container and acting as a smoke conduit and a smoke outlet through which smoke can be drawn by a user during smoking. During use, the liquid container is at least partially filled with liquid, such as water, and the hollow pipe, or an extension of the pipe, extends into the liquid container below the liquid level, such that smoke drawn from the smoke source is deposited within the liquid.

The smoke source is typically a bowl containing tobacco, or some other smokable substance, located above or at a top of the hollow pipe combined with a heat generating element resting above the bowl. Such a heat generating element may be a plate containing charcoal or a more sophisticated mechanism for controlling the burning of charcoal or otherwise generating heat. Smoke from the heated smokable substance in the bowl is then provided to the liquid container by way of the hollow pipe, sometimes referred to as a downstem.

The smoke outlet, through which the user draws the smoke, is located above the liquid level, or otherwise outside of the liquid contained in the liquid container, such that smoke can be drawn through the smoke outlet only after it emerges from the liquid in the liquid container.

During use, it is difficult to evenly heat the smokable substance contained in the bowl. This is partially because the heat is often generated by burning charcoal, which is inherently uneven, and it is partially because the smokable substance is often packed into the bowl tightly. Further, the bowl itself may be formed or partially formed from materials that do not conduct heat. Accordingly, the heat as generated may be uneven, and the smokable substance within the bowl may be heated unevenly. As such, parts of the smokable substance may be overheated and charred while other parts of the smokable substance may not be heated sufficiently.

There is a need for a system or device for ensuring that a smokable substance is heated evenly when heated in a hookah.

SUMMARY

Assemblies and inserts are provided for evenly heating a smokable sub stance.

In one embodiment, a hookah bowl insert is provided for heating a smokable substance. The insert may have a central core having at least one passageway extending therethrough.

The insert may further have a plurality of radial extensions extending in a radial direction from the central core. The radial extensions may be for gripping the smokable substance therebetween, and each radial extension may further have a vertical extension extending in a direction perpendicular to the radial direction.

The insert is formed from a heat conductive material, such that heat is distributed across the insert, and within the individual radial and vertical extensions. Generally, each vertical extension has a thickness larger than a thickness of the insert at the central core. As such, the vertical extensions can maintain stable temperatures and transfer heat to and from the smokable substance located therebetween.

In some embodiments, the central core is substantially planar, and the radial extensions are sloped relative to a first plane of the central core. The radial extensions then extend to a second plane different from the first plane, and when in use, the radial extensions are then below the central core. The vertical extensions then extend from the second plane to the first plane.

In some such embodiments, a top of the vertical extensions extends above the first plane, such that a heat source having a planar lower surface rested on top of the vertical extensions would be suspended above the central core and would not contact the central core.

In some such embodiments, a connection segment of the insert circumferentially surrounds the planar segment of the central core and slopes for the first plane to the second plane. In some such embodiments, at least one fixation element is provided for fixing the connection segment to an interior surface of a hookah bowl. The fixation element may be, for example, a plurality of protrusions for bracing the insert against a protruding pipe opening of the hookah bowl.

The central core may be configured to be located above a pipe opening in a hookah bowl, such that the at least one passageway extending therethrough is aligned with the pipe opening.

The vertical extensions may each have a horizontal section with a bunging profile, such that the profile of each vertical extension bulges towards an adjacent vertical extension of an adjacent radial extension, such the smokable substance, when inserted, is gripped between the vertical extension bulges of adjacent vertical extensions.

In some embodiments, the insert may be formed from a single piece.

A hookah bowl assembly is provided for evenly heating a smokable substance. The hookah bowl assembly comprises a bowl head, the bowl head having an interior space defined by an inner surface, a hollow central pipe, and a stalk below the central pipe. The stalk encloses an extension of the central pipe for transmitting smoke from the interior space.

A bowl insert is then provided similar to that discussed above.

In some embodiments, the hollow central pipe protrudes into the interior space of the bowl head, and the protrusions of the insert then brace the insert against the protruding hollow pipe.

When assembled, the central core is configured to be located above the hollow central pipe when inserted into the bowl head. As such, the at least one passageway extending through the central core is aligned with the hollow central pipe.

In some embodiments, the insert is permanently fixed to the inner surface of the bowl head.

Also provided is an additional hookah bowl assembly for evenly heating a smokable substance. The hookah bowl assembly comprises a bowl head having an interior space defined by an inner surface, a hollow central pipe, and a stalk below the central pipe, the stalk enclosing an extension of the central pipe for transmitting smoke from the interior space.

The bowl head further comprises a plurality of vertical extensions extending from the inner surface, the vertical extensions arranged radially about the hollow central pipe, wherein each vertical extension is formed from a heat conductive material.

The vertical extensions of the hookah bowl assembly may each be provided with a horizontal section with a bulging profile, such that the profile of each vertical extension bulges towards an adjacent vertical extension such that the smokable substance, when inserted, is gripped between the vertical extension bulges of adjacent vertical extensions.

In some embodiments, the hollow central pipe protrudes into the interior space of the bowl head, and a top of the hollow central pipe defines a first plane, and a top of at least a subset of the plurality of the vertical extensions extends above the first plane. As such, a heat source having a substantially planar lower surface rested on top of the vertical extensions would be suspended above the hollow central pipe and would not contact the hollow central pipe.

DETAILED DESCRIPTION OF THE PREFERRED EMBODIMENTS

Figure 1A:
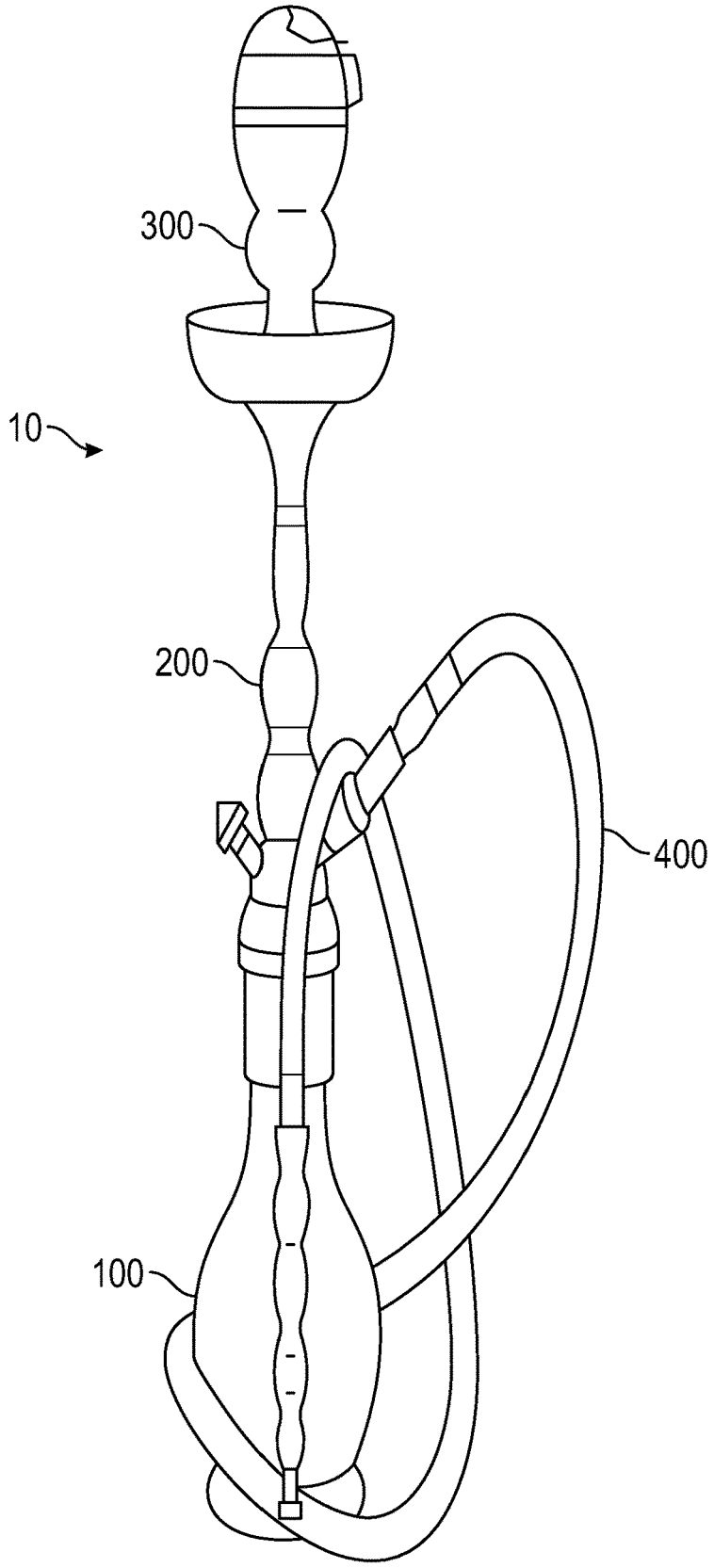
FIG. 1A illustrates an example embodiment of a water pipe in accordance with the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1A illustrates an example embodiment of a water pipe 10 in accordance with the present invention. As shown in FIG. 1A, the water pipe generally comprises: a base 100, a stem 200, a bowl 300, and a hose 400.

Figure 1B:
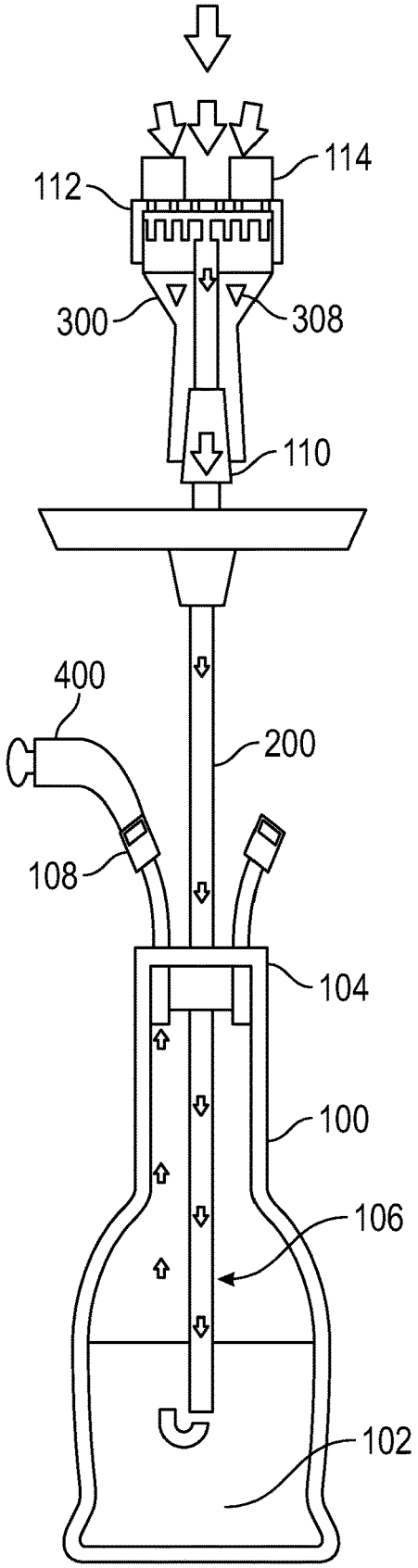
FIG. 1B shows a schematic view of an example embodiment of a water pipe in accordance with the present invention.

FIG. 1B shows a schematic view of an example embodiment of a water pipe in accordance with the present invention. In general, the base 100 comprises a concave vessel having an open top portion for containing water or other liquid 102 therein. The stem 200 extends into the base such that a distal end of the stem is partially submerged within the liquid 102 contained therein. The stem 200 also couples to the open top portion of the base so as to form a substantially airtight seal therewith. Accordingly, a first base grommet 104 may be provided to couple the stem 200 and the base 100 so as to form the substantially airtight seal. In this manner, a chamber is formed by the base 100 and stem 200/grommet 104 assembly.

The hose 400 extends into the base 100 such that a proximal portion of the hose 400 is in fluid communication with the chamber 106, though preferably not within the contained liquid 102 (e.g. air can pass between chamber 106 and hose 400). Preferably, a substantially airtight seal is formed from the coupling of the hose 400 and base 100. Accordingly, a second hose grommet 108 may be provided to couple the hose 400 and the base 100 so as to form the substantially airtight seal. In some embodiments, a hose valve (not shown) may be intermediate the hose 400 and the base 100, the hose valve extending into the chamber 106 at one end and exterior to the chamber 106, coupling with the hose 400, at the other.

Bowl 300 couples to a proximal end of stem 200 such that a substantially airtight seal is formed therebetween. Accordingly, a third bowl grommet 110 may be provided to couple bowl 300 and stem 200 so as to form the substantially airtight seal. In operation, organic matter to be smoked 308 may be contained within bowl 300, and bowl 300 may be covered with a cover 112, such as punctured foil, or a ventilated cover. Coals 114 or other combustible heating material can be placed on or in cover 112 to heat the tobacco 308. Further, while coals are shown resting on a foil cover, more sophisticated heating devices are contemplated as well. Accordingly, coals may be located inside such a heating device, such that air flow to and from the coals may be controlled. Alternatively, the coals may be replaced with an alternative form of heating, such as an electric, gas based, or other heating system.

Generally, bowl 300, stem 200 and hose 400 each comprise a hollow tube such that when base 100, bowl 300, stem 200 and hose 400 are coupled, an airflow path is formed. As illustrated in FIG. 1B, a user inhaling at the distal end of hose 400 may thus draw heated air into bowl 300, causing the organic material 308 therein to burn, releasing smoke that is subsequently drawn through bowl 300, through stem 200, and into liquid 102 contained within chamber 106 of base 100. The smoke then rises through liquid 102 into the preferably sealed area above liquid 102 in the chamber 106, becoming filtered in the process, and inhaled through hose 400 as it is smoked by the user.

It will be understood that the examples of 1A and 1B are typical hookah structures, but a wide variety of distinct shapes are possible as well. As such, the base 100 may take many different shapes, and in some examples, the bowl 300 may be connected directly to the base 100 in order to form a more compact hookah. It is further noted that while smoke is discussed, smoking activities may include generation of alternative inhalable substances, such as vapor during "vaping." The structures described herein will be understood to apply equally in the context of vaping, for example.

Figure 2:
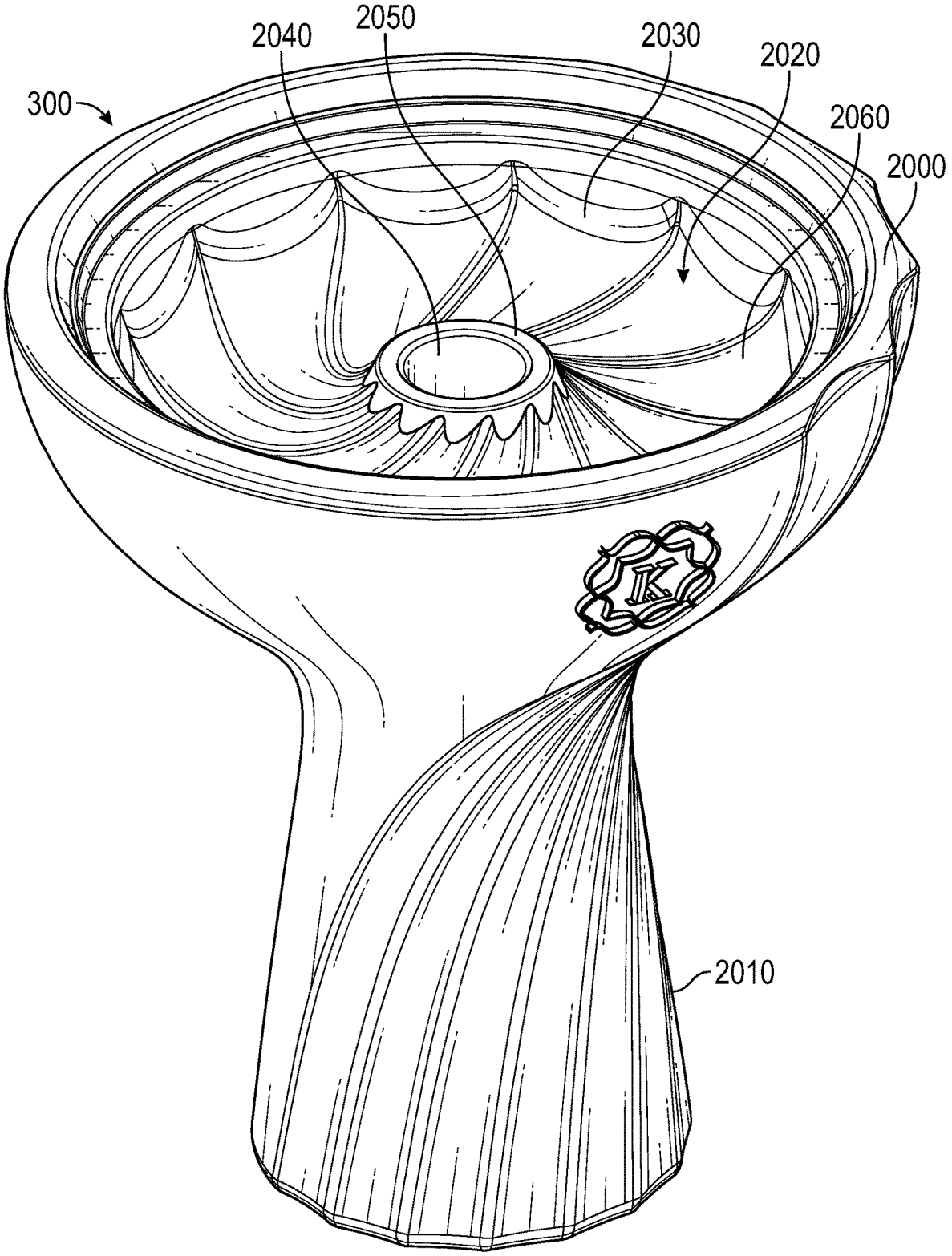
FIG. 2 shows a perspective view of a bowl in accordance with this disclosure.
Figure 3:
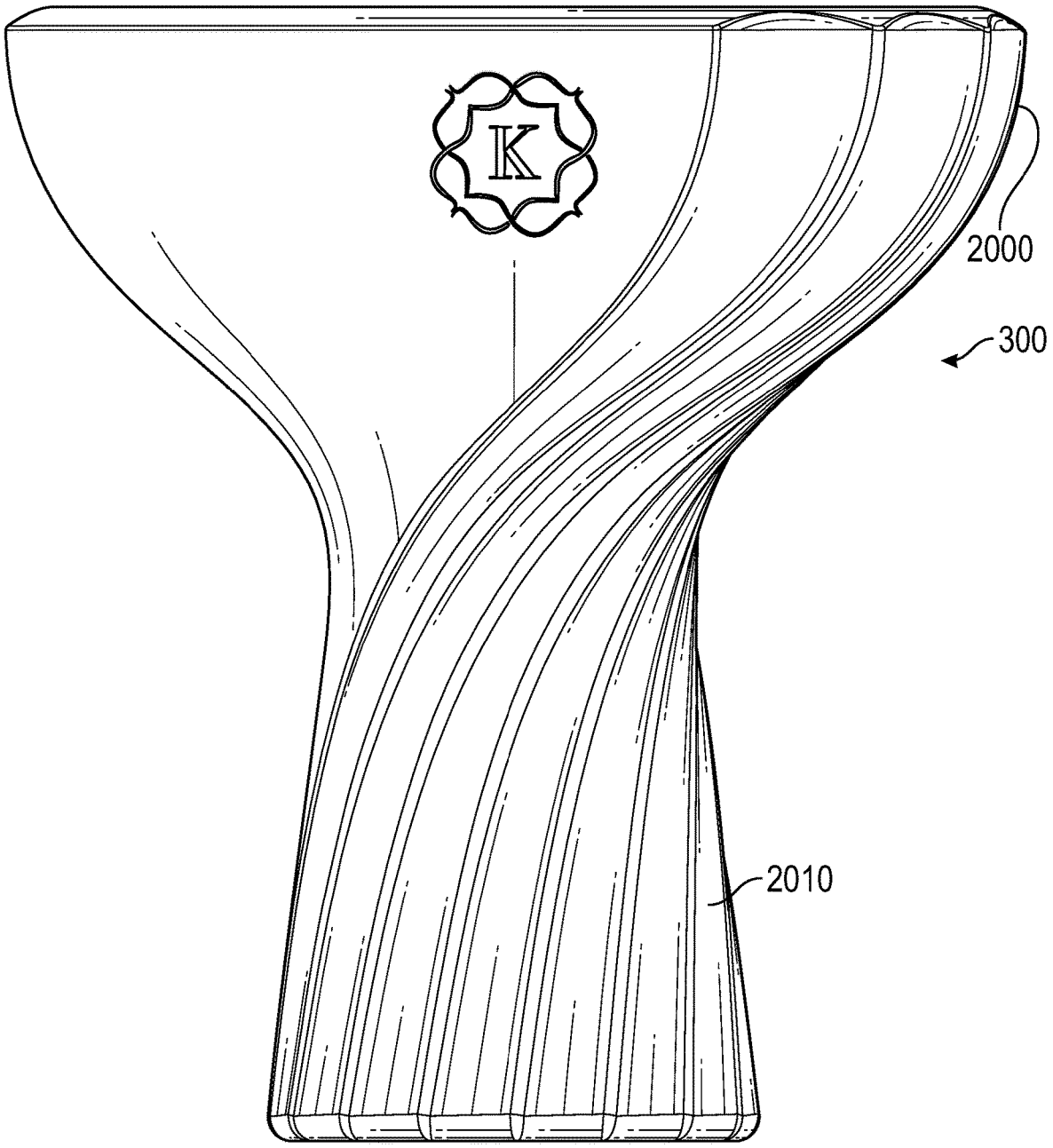
FIG. 3 shows a side view of the bowl of FIG. 2.

FIG. 2 shows a perspective view of a bowl 300 in accordance with this disclosure. FIG. 3 shows a side view of the bowl 300 of FIG. 2.

As shown, bowl 300 generally comprises a substantially hemispherical bowl head 2000 extending vertically and radially from a substantially cylindrical bowl stalk 2010. As shown, bowl stalk 2010 may be flared outward at its bottom end to facilitate easier manipulation and coupling with a stem, as previously described. Bowl 300 preferably further comprises an interior space 2020 defined by an inner surface 2030. Further, as shown, located central to the bowl head 2000, and forming a portion of the inner surface 2030 of the bowl 300, may be a hollow central pipe 2040 extending a complete height of the bowl 300 from the bowl head 2000 through the bowl stalk 2010. Hollow central pipe 2040, and other structures herein described, are additionally shown in FIG. 10, which is a cross-sectional illustration of the exemplary bowl 300.

The hollow central pipe 2040, extending through and enclosed within the bowl stalk 2010, then transmits smoke from the interior space 2020 to the stem 200 after which the smoke can be drawn into the base 100. Further, as shown, in some embodiments, the hollow central pipe 2040 may protrude into the interior space 2020 of the bowl head 2000. As such, a protrusion 2050 may rise above a lowest point of the inner surface 2030, and a circumferential channel 2060 may be defined around the protrusion 2050. Smokable substance may then be located within the circumferential channel 2060 such that the smokable substance is arranged around the hollow central pipe 2040.

In this way, the circumferential channel 2060 retains smokable substance, which is heated from above by the charcoal 114, in the example of FIG. 1B. When a user inhales smoke through the hose 400, heated air is drawn into the bowl 300, as discussed above, and heats the smokable substance. Smoke from the smokable substance is then drawn from the bowl into the hollow central pipe 2040.

Figure 4A:
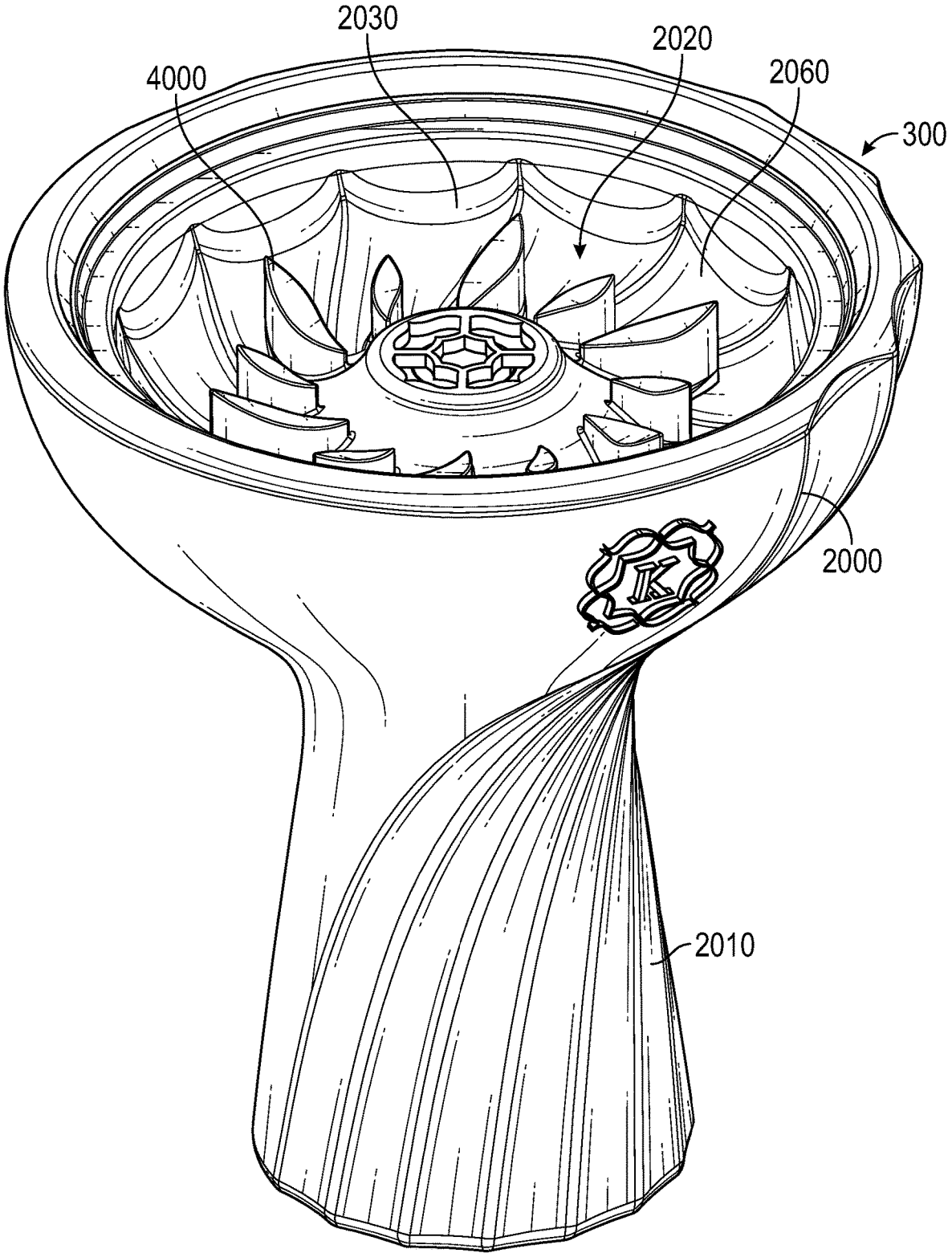
FIG. 4A shows a perspective view of the bowl of FIG. 2 with an added insert in accordance with this disclosure.
Figure 4B:
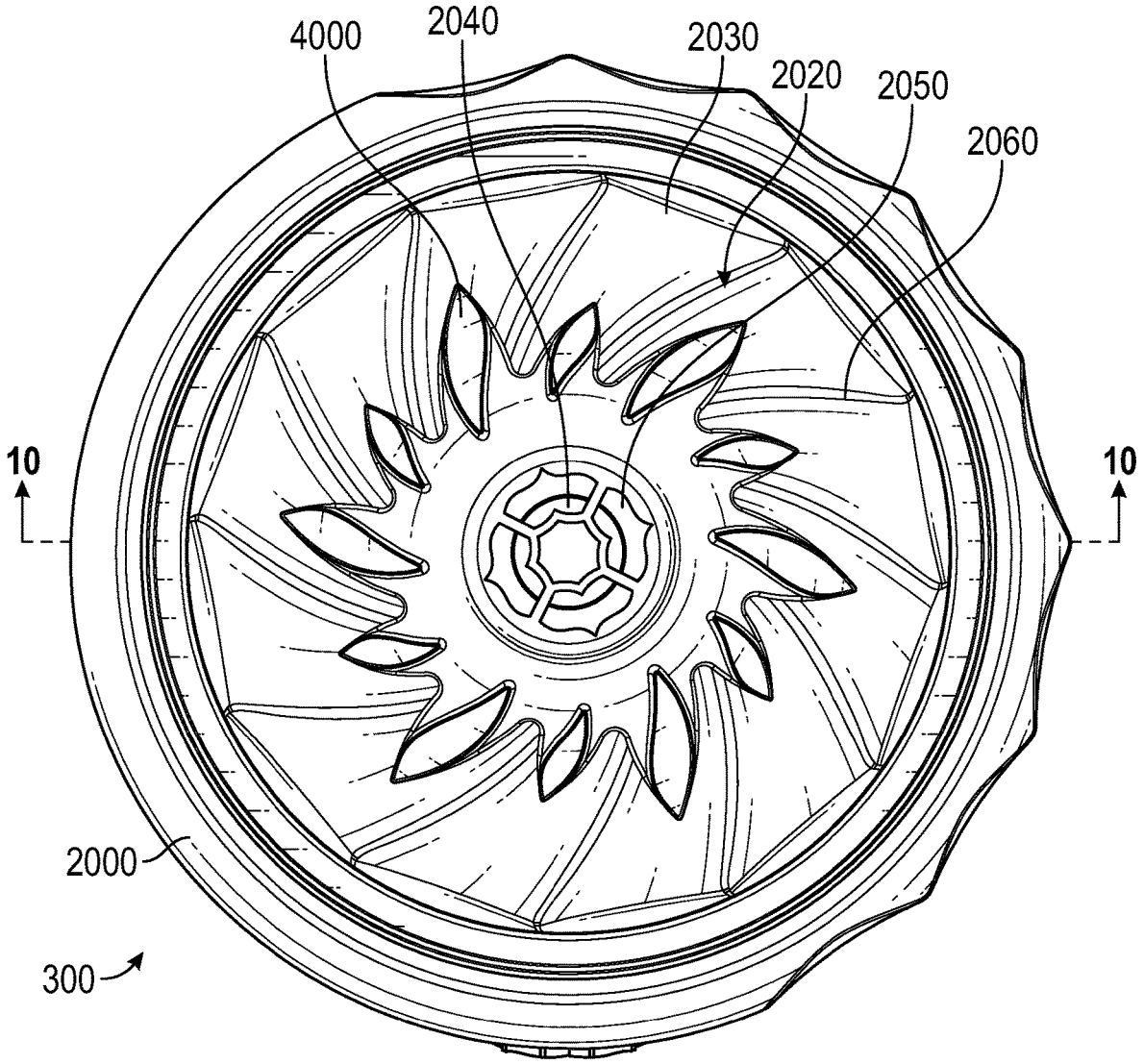
FIG. 4B shows a top view of the bowl of FIG. 2 with the added insert of FIG. 4A.
Figure 5:
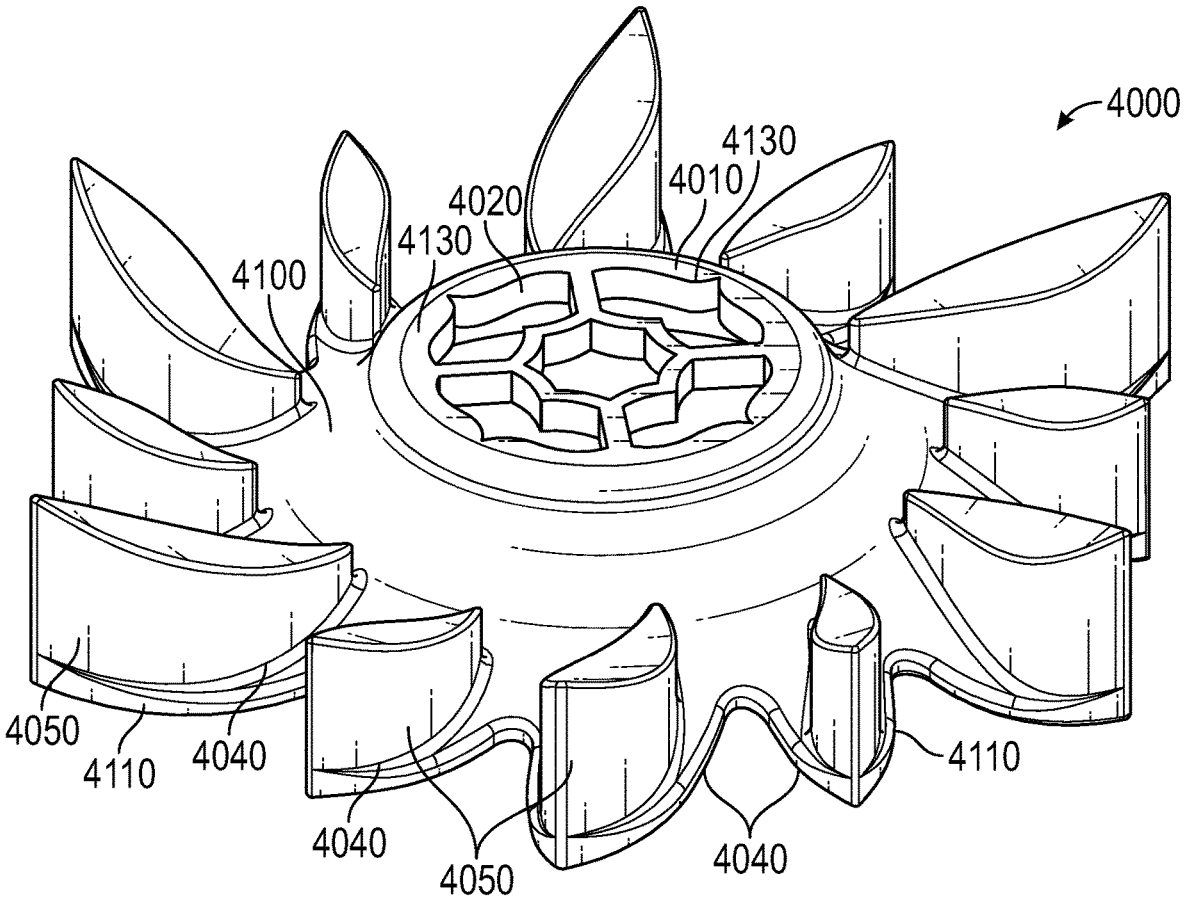
FIG. 5 shows a perspective view of an insert in accordance with this disclosure.
Figure 6:
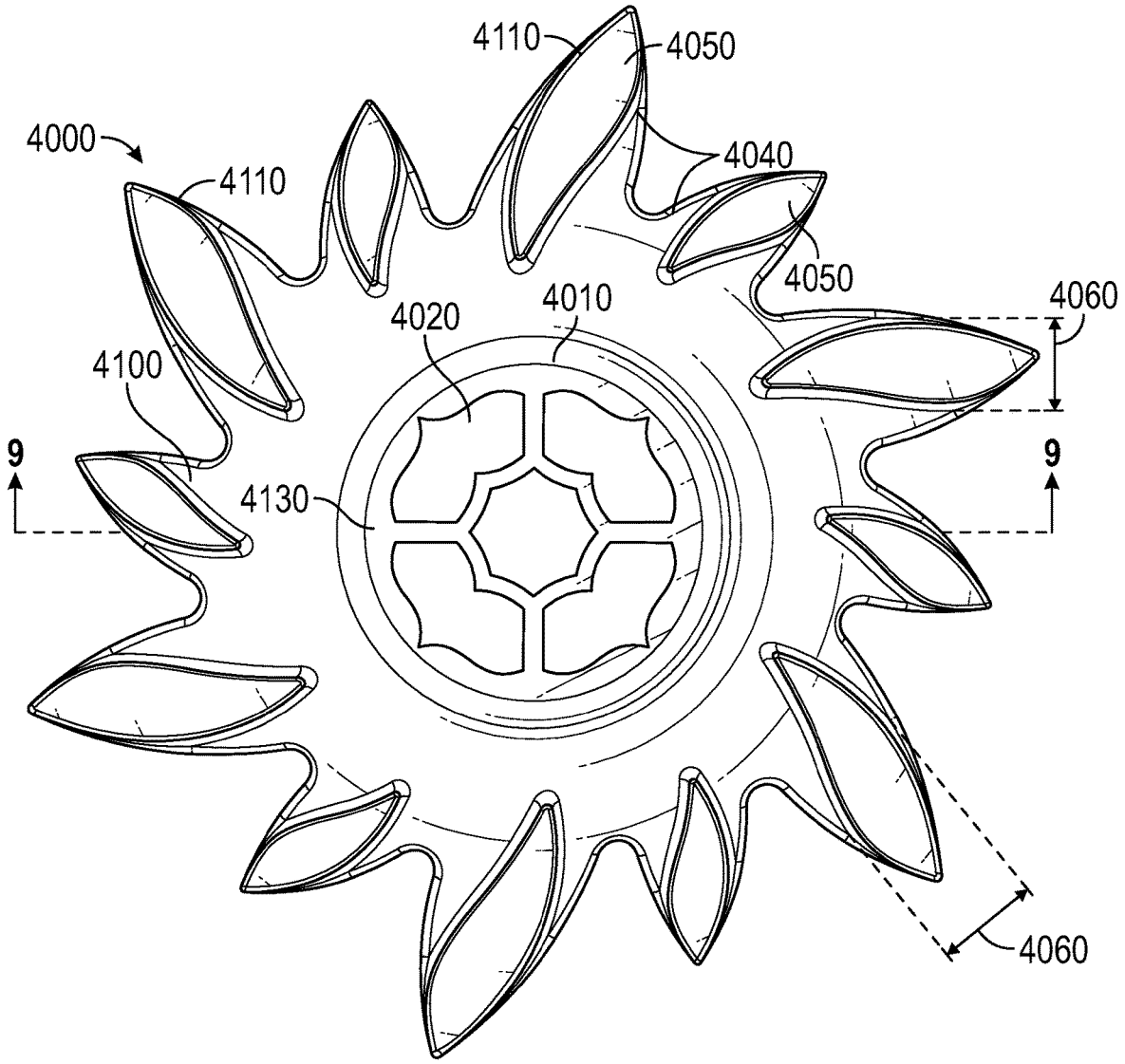
FIG. 6 shows a top view of the insert of FIG. 5.
Figure 7:
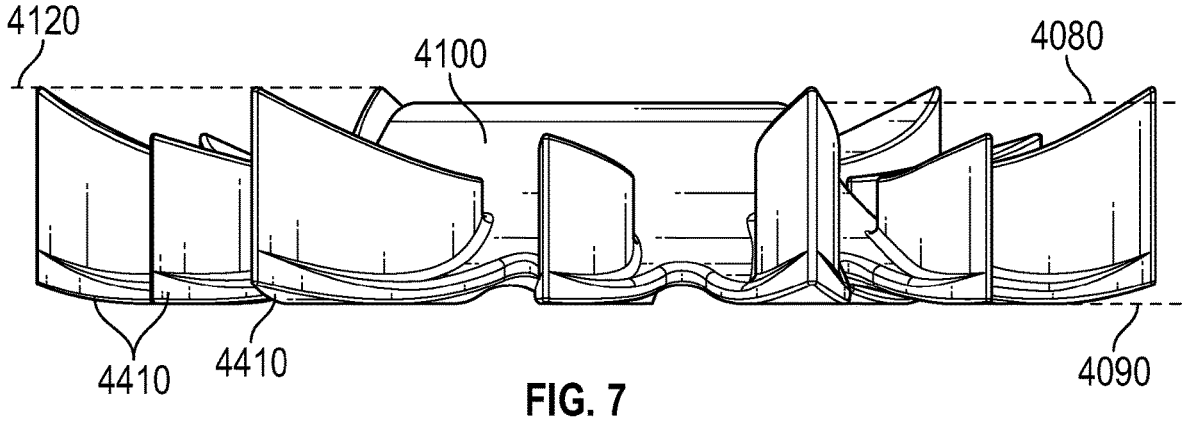
FIG. 7 shows a side view of the insert of FIG. 5.
Figure 8:
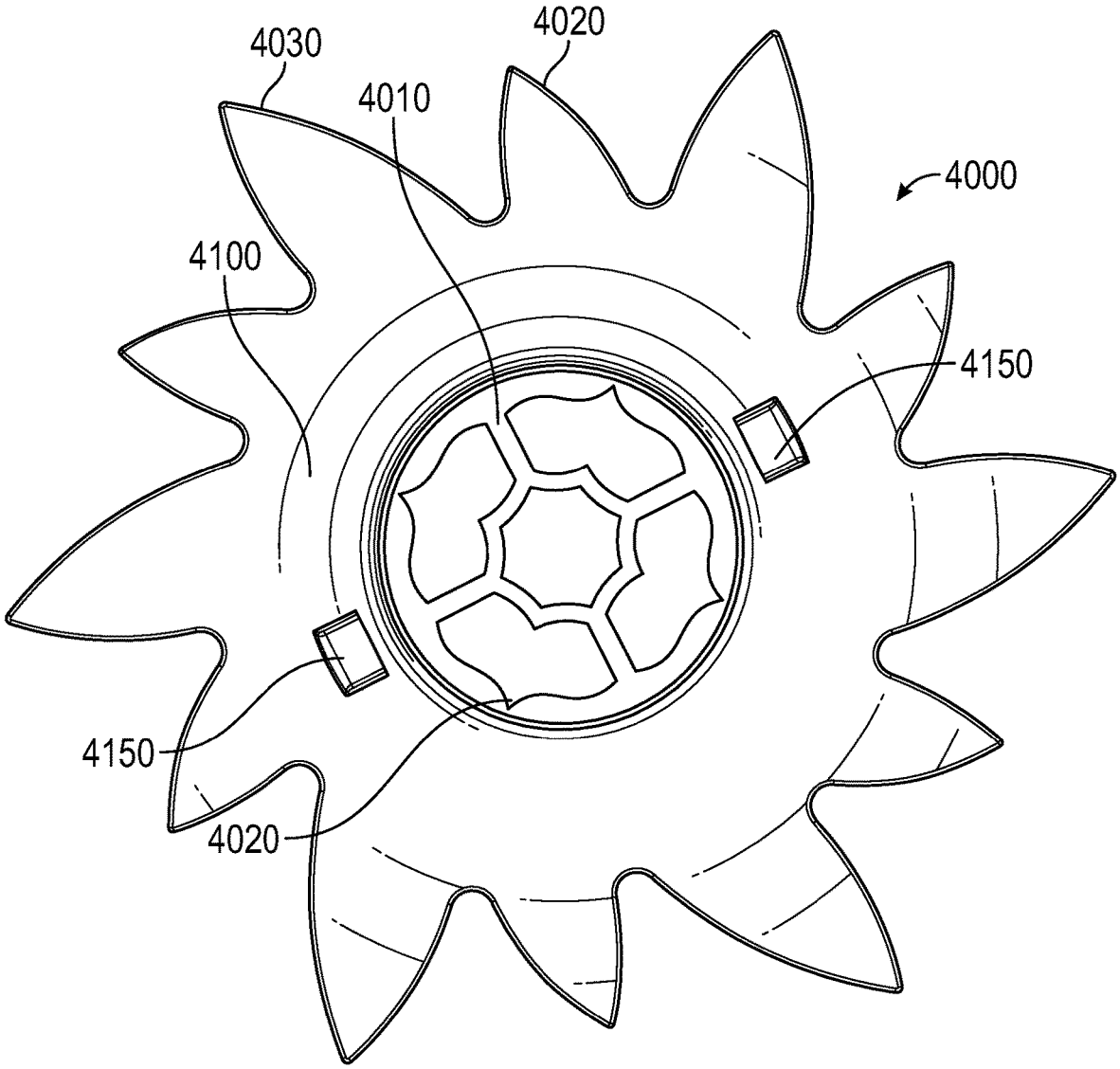
FIG. 8 shows a bottom view of the insert of FIG. 5.
Figure 9:
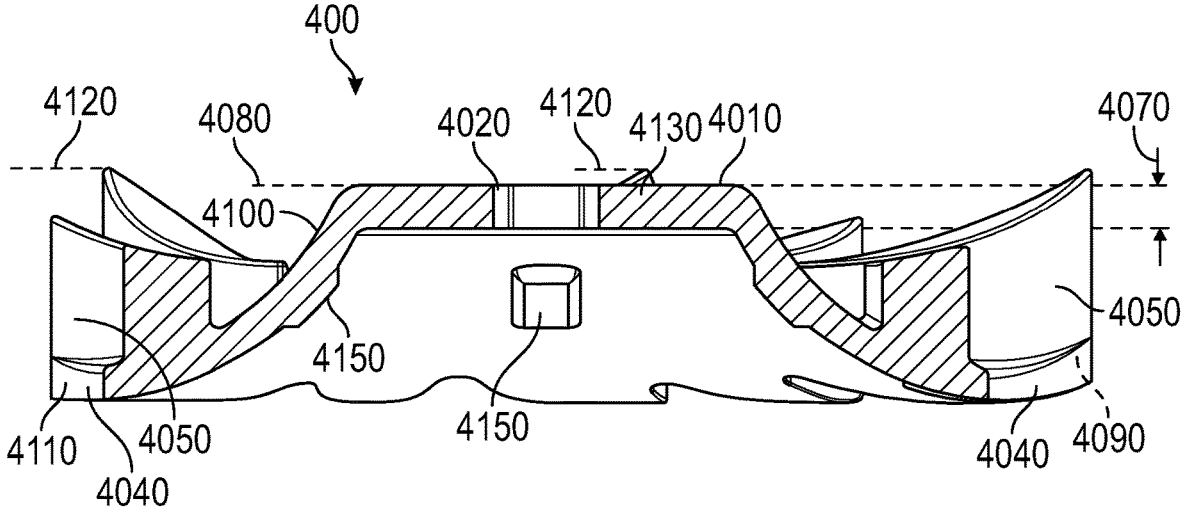
FIG. 9 shows a sectioned view of the insert of FIG. 5, taken along line 9-9 of FIG. 6.
Figure 10:
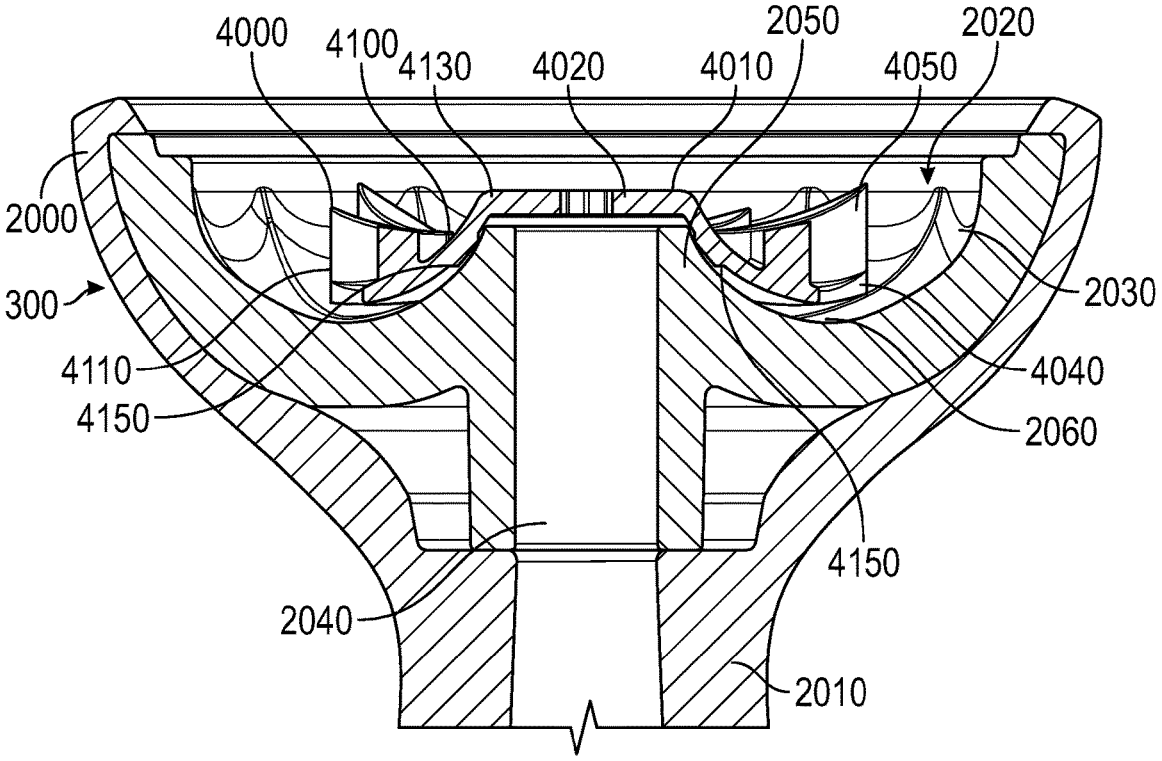
FIG. 10 shows a sectioned view of the bowl of FIG. 2 with the insert of FIG. 5 taken along line 10-10 of FIG. 4B.

FIG. 4A shows a perspective view of the bowl 300 of FIG. 2 with an added insert 4000 in accordance with this disclosure. FIG. 4B shows a top view of the bowl 300 of FIG. 2 with the added insert 4000 of FIG. 4A. FIG. 5 shows a perspective view of the insert 4000 in accordance with this disclosure. FIG. 6 shows a top view of the insert 4000, FIG. 7 shows a side view of the insert, and FIG. 8 shows a bottom view of the insert. FIG. 9 shows a sectioned view of the insert 4000 of FIG. 5, taken along line 9-9 of FIG. 6. FIG. 10 shows a sectioned view of the bowl 300 of FIG. 2 with the insert 4000 of FIG. 5 taken along line 10-10 of FIG. 4B.

The hookah bowl insert 4000 shown is for evenly heating a smokable substance. The insert 4000 shown is generally placed into a hookah bowl 300 such as that discussed above, and the smokable substance is placed onto or fixed to elements of the insert, as discussed in more detail below. Accordingly, instead of locating the smokable substance in the circumferential channel 2060 of the bowl head 2000, the smokable substance is applied to the insert 4000 which is then placed in the bowl head 2000.

The insert 4000 has a central core 4010, which has at least one passageway 4020 extending through the central core. The central core 4010 is generally configured to be located above a pipe opening of the hollow central pipe 2030 of the bowl 300. As such, the at least one passageway 4020 is located above the pipe opening and is aligned with the hollow central pipe 2030. As such, any smoke drawn into the hollow central pipe 2030 is drawn from above the insert 4000 through the at least one passageway 4020.

As shown, the at least one passageway 4020 may be multiple passageways or openings forming a latticework. Such a latticework may be patterned to present, for example, a logo design, or any other aesthetic design. Generally, the passageway 4020 or combined area of the multiple passageways, is large relative to the area of the central core 4010 located above the hollow central pipe 2030 so as to avoid obstructing the flow of smoke from the interior space 2030 of the bowl head 2010 into the hollow central pipe during use, while still preventing tobacco or other loose matter from falling into the hollow central pipe 2030.

The insert 4000 further includes a plurality of radial extensions 4040 extending in a radial direction from the central core 4010 for gripping the smokable substance. As shown, each radial extension 4040 typically further has a vertical extension 4050 extending in a direction perpendicular to the radial direction. The smokable substance may then be gripped in between the vertical extensions 4050 of adjacent radial extensions 4040. Accordingly, when using the insert 4000, the smokable substance is placed between the vertical extensions 4050 instead of being placed on the inner surface 2030 within the circumferential channel 2060 of the bowl 300.

It is noted that the radial extensions 4040 need not extend precisely radially from the central core 4010. As shown, the radial extensions 4040 may form a spiral or the like when extending from the central core 4010, and may therefore bend towards adjacent extensions. Similarly, as discussed below, the radial extensions 4040 may slope away from the central core 4010, and may therefore be located in a plane distinct from that of the central core, or take any other shape with variations in width and height.

The insert 4000 is typically formed from a heat conductive material, such that when heated air is drawn into the interior space 2020 of the bowl, the insert 4000 is heated relatively evenly. Similarly, in some embodiments, the insert 4000 is formed from a single piece of material, such that heat conducts throughout the insert efficiently. Accordingly, the insert 4000 may be formed from a single piece or multiple pieces of metal, ceramic, stone, or any combination thereof.

Generally, the vertical extensions 4050 each have a thickness 4060 thicker than the other components of the insert 4000, such as the central core 4010. Accordingly, the central core 4010 may be substantially planar, with a thickness 4070 smaller than the thickness 4060 of the vertical extensions 4050. This allows the extensions to retain heat during use, such that the heating of the smokable substance itself is even regardless of fluctuations in the temperature of air drawn into the bowl 300 from the heat source.

In some embodiments, the central core 4010 rests on top of or on the protrusion 2050 of the hollow central pipe 2040 into the bowl. The radial extensions 4040 may then be configured to locate the smokable substance within the circumferential channel 2060 below the level of the protrusion 2050. As such, the substantially planar central core 4010 may be located in a first plane 4080 during use. The radial extensions 4040 may then be at least partially sloped relative to the first plane 4080 such that they extend to a second plane 4090 different than the first plane.

In some embodiments, the radial extensions 4040 may each be provided with, or may be fixed to, a sloped segment 4100 of the insert 4000. The radial extensions 4040 may then comprise a substantially planar segment 4110 in the second plane 4090 parallel to the first plane 4080. As such, the substantially planar segment 4110 may retain the smokable substance within the circumferential channel 2060. As shown, the substantially planar segment 4110 of the radial extensions 4040 may define the entirety of those extensions. However, in some embodiments, the radial extension may further comprise part of or the entirety of the sloped segment 4100.

As shown, where the radial extensions 4040 slope away from the central core 4010, the vertical extensions 4050 may then extend from the second plane 4090 to the first plane 4080. Further, in some embodiments, a plane defined by a top 4120 of at least some of the vertical extensions 4050 may rise above the first plane 4080. As such, if a heat source having a planar lower surface is rested on top of the vertical extensions 4050, it would be suspended above the central core 4010 and would not contact the central core.

In some embodiments, the sloped segment 4100 of the insert 4000 may define a connection segment of the central core 4010 and circumferentially surround a central planar segment 4130 of the central core 4010 and may then slope from the first plane 4080 to or towards the second plane 4090. As shown, the radial extensions 4040 may then extend from the sloped connection segment 4100 rather than the planar segment 4130 of the central core 4010. As noted above, in other embodiments, the sloped segment 4100 may be defined into discrete extensions and may thereby form portions of the radial extensions 4040 rather than a portion of the central core 4010.

As shown, in some embodiments, each of the vertical extensions 4050 of the insert 4000 has a horizontal section with a bulging profile, such that the profile of each vertical extension bulges towards an adjacent vertical extension. The thickness 4060 of the vertical extensions 4050 may then be measured at the bulge of the corresponding profile, and the smokable substance, when inserted, is then gripped between the vertical extension bulges at adjacent vertical extensions.

In some embodiments, the insert 4000 further has at least one fixation element 4150, which may be used to fix the insert to the interior surface 2030 of the bowl 300. The fixation element may simply be a protrusion, as shown, for bracing the insert 4000 against the protrusion 2050 of the hollow central pipe 2040 of the bowl 300.

Figure 11:
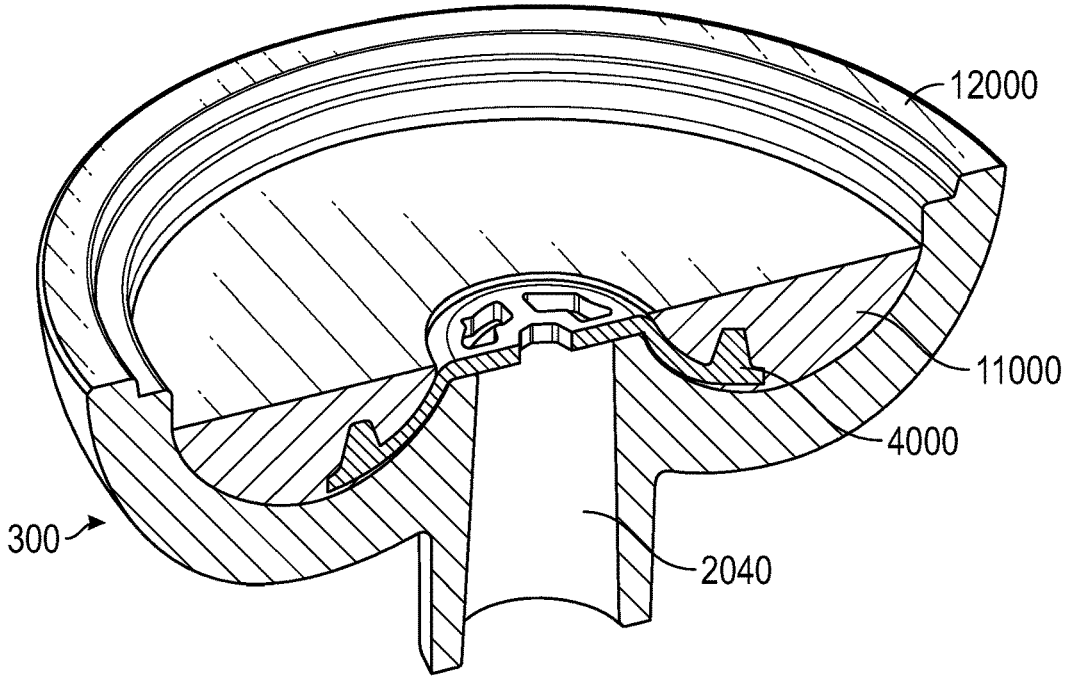
FIG. 11 shows the bowl of FIG. 2 with the added insert of FIG. 4A in use.

FIG. 11 shows the bowl 300 of FIG. 2 with the added insert 4000 of FIG. 4A in use. As shown, the insert is packed with a smokable substance, such as tobacco 11000. The tobacco encloses the vertical extensions 4050, and the vertical extensions can then distribute heat evenly throughout the packed tobacco 11000.

It will be understood that the insert 4000 shown is one of many different embodiments contemplated. Alternative embodiments may include features of the insert fused into the bowl itself without having an independent insert. Accordingly, the insert may be permanently installed on, or embedded into, the bowl head 2000. Alternatively, in some embodiments, the central hub 4010 may be replaced with a simple hub retaining spokes, with each spoke functioning as a radial extension.

Figure 12:
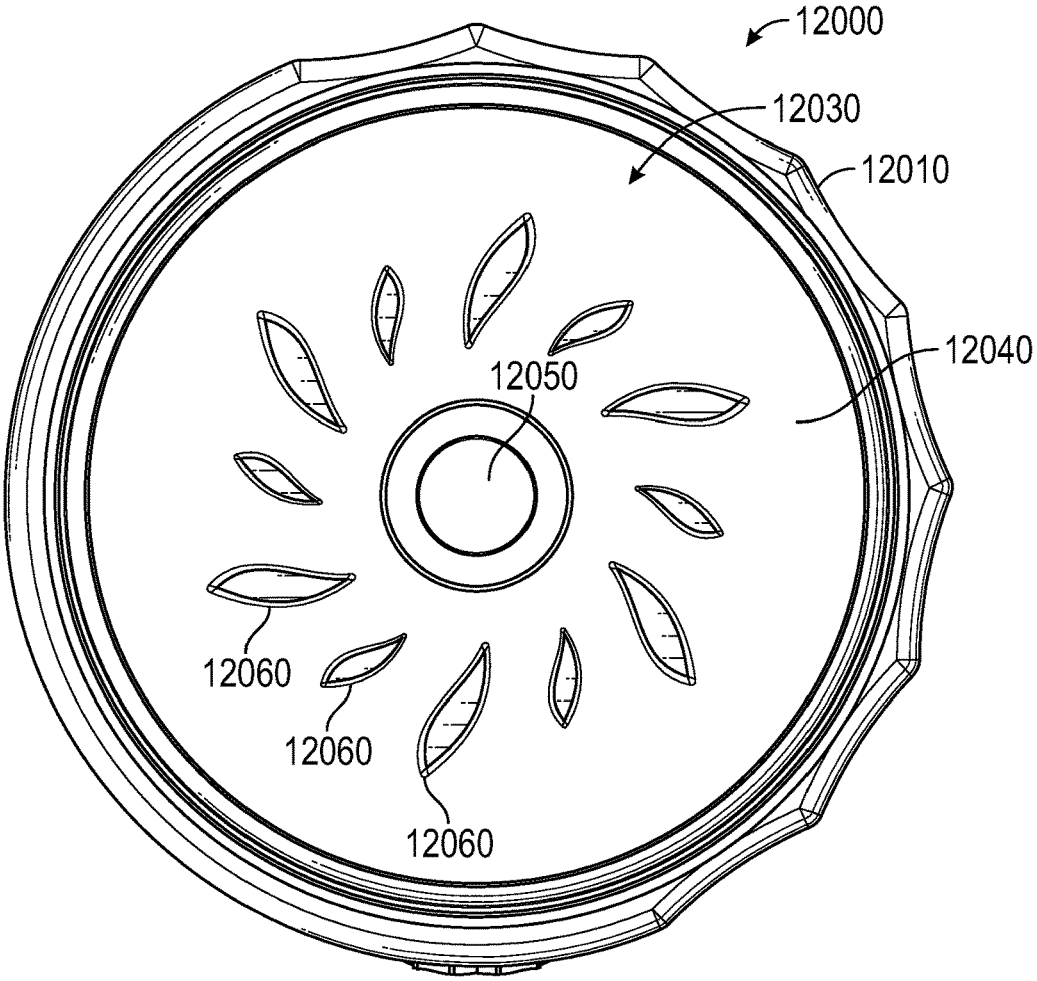
FIGS. 12, 13, and 14 show a second embodiment of a bowl in accordance with this disclosure.
Figure 13:
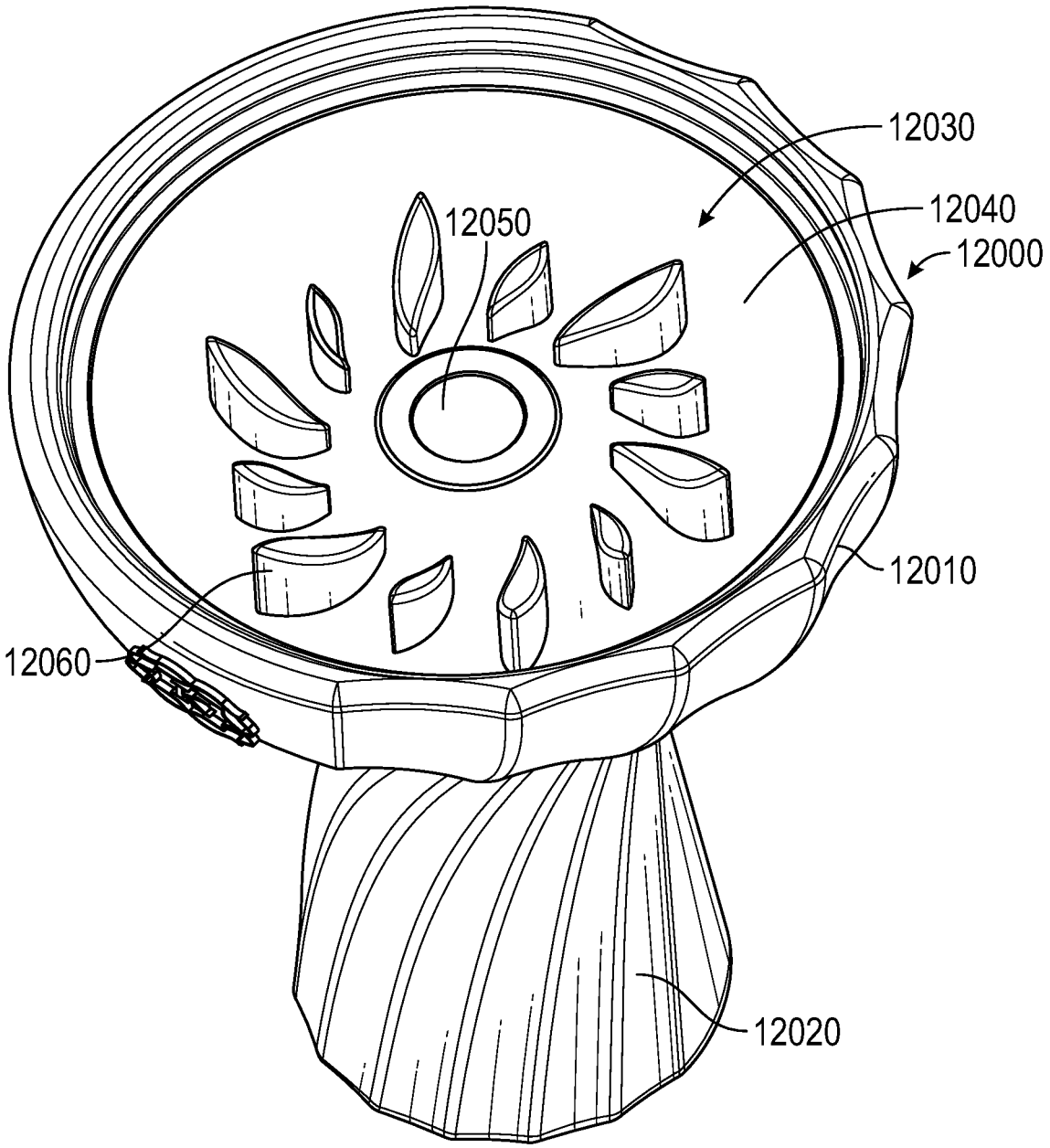
Figure 14:
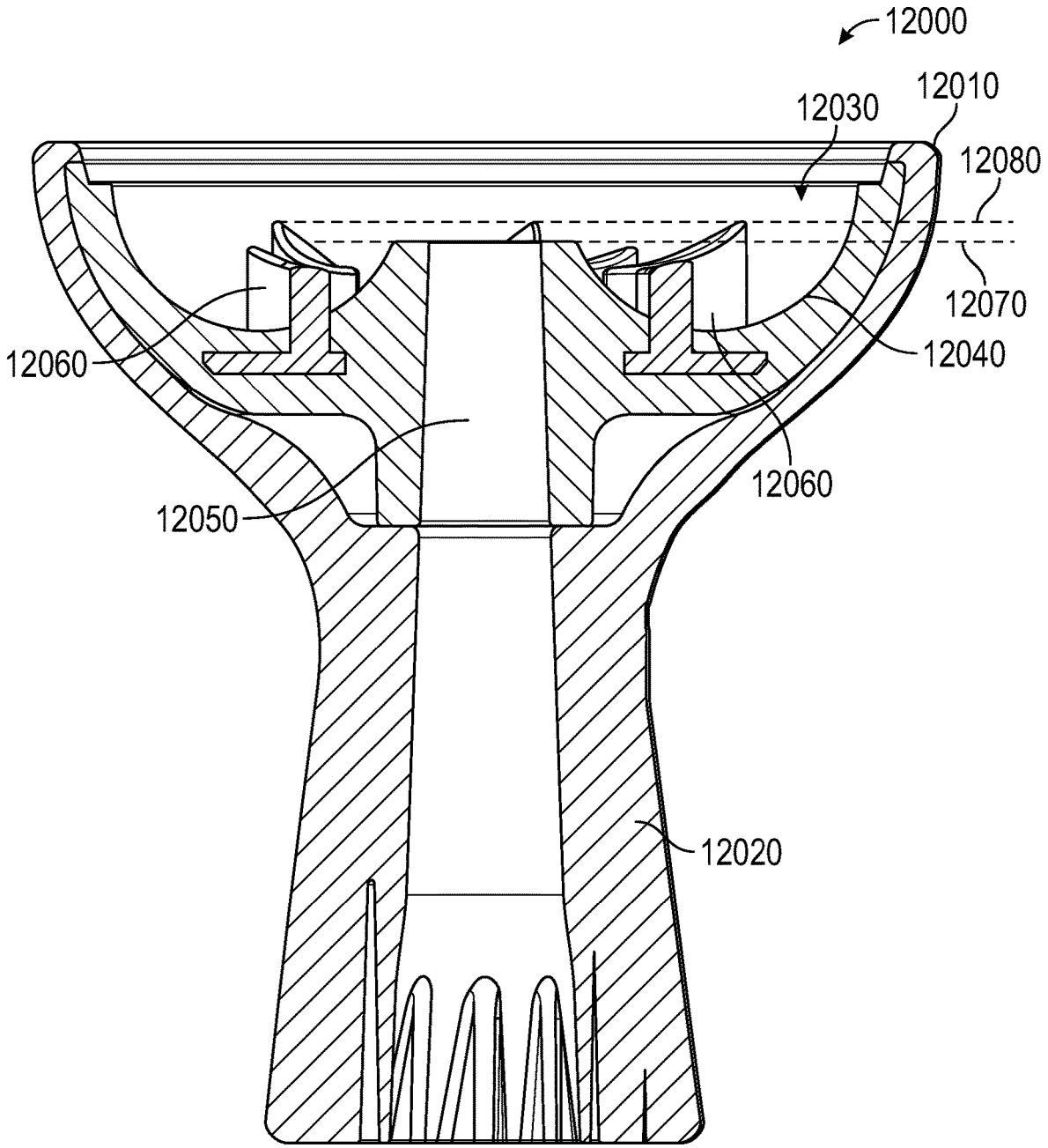

FIGS. 12, 13, and 14 show a second embodiment of a bowl 12000 in accordance with this disclosure. The bowl 12000 shown has a substantially hemispherical bowl head 12010 that extends vertically and radially from a substantially cylindrical bowl stalk 12020, as discussed above with respect to the first embodiment. The bowl head 12010 is then provided with an interior space 12030 defined by an inner surface 12040. The bowl head further has a hollow central pipe 12050 located centrally within the bowl head 12010 and forming a portion of the inner surface 12040. The hollow central pipe typically extends below the bowl head 12010 and through the bowl stalk 12020. The stalk 12020 thereby encloses an extension of the central pipe 12050 for transmitting smoke from the interior space 12030.

Embedded in inner surface 12040 of the bowl head 12010 are a plurality of vertical extensions 12060, each of which are arranged radially about the hollow central pipe 12050. These vertical extensions 12060 are generally similar to and may have characteristics parallel to the vertical extensions 4050 discussed above with respect to other embodiments. Accordingly, the vertical extensions 12060 may each be formed from a heat conductive material.

As discussed above, with respect to other embodiments, each vertical extension 12060 may have a horizontal section with a bulging profile. As such, when viewed from above, the profile of each vertical extension 12060 bulges towards an adjacent vertical extension such that the smokable substance, when inserted, is gripped between the vertical extension bulges of adjacent vertical extensions.

In some embodiments, the hollow central pipe 12050 protrudes into the interior space 12030 of the bowl head 12010. Accordingly, a top of the hollow central pipe may define a first plane 12070. In such embodiments, a top 12080 of at least a subset of the vertical extensions 12060 extends above the first plane 12070, such that a heat source having a substantially planar lower surface rested on top of the vertical extensions would be suspended above the hollow central pipe 12050 and would not contact the hollow central pipe.

In the embodiment shown, the vertical extensions 12060 are anchored to an inner surface 12040 of the bowl head 12010. However, in some embodiments, the plurality of vertical extensions 12060 are instead removably fixed to the inner surface 12040, such that they can be removed for cleaning or to change the number of vertical extensions 12060 present in the bowl.

Figure 15:
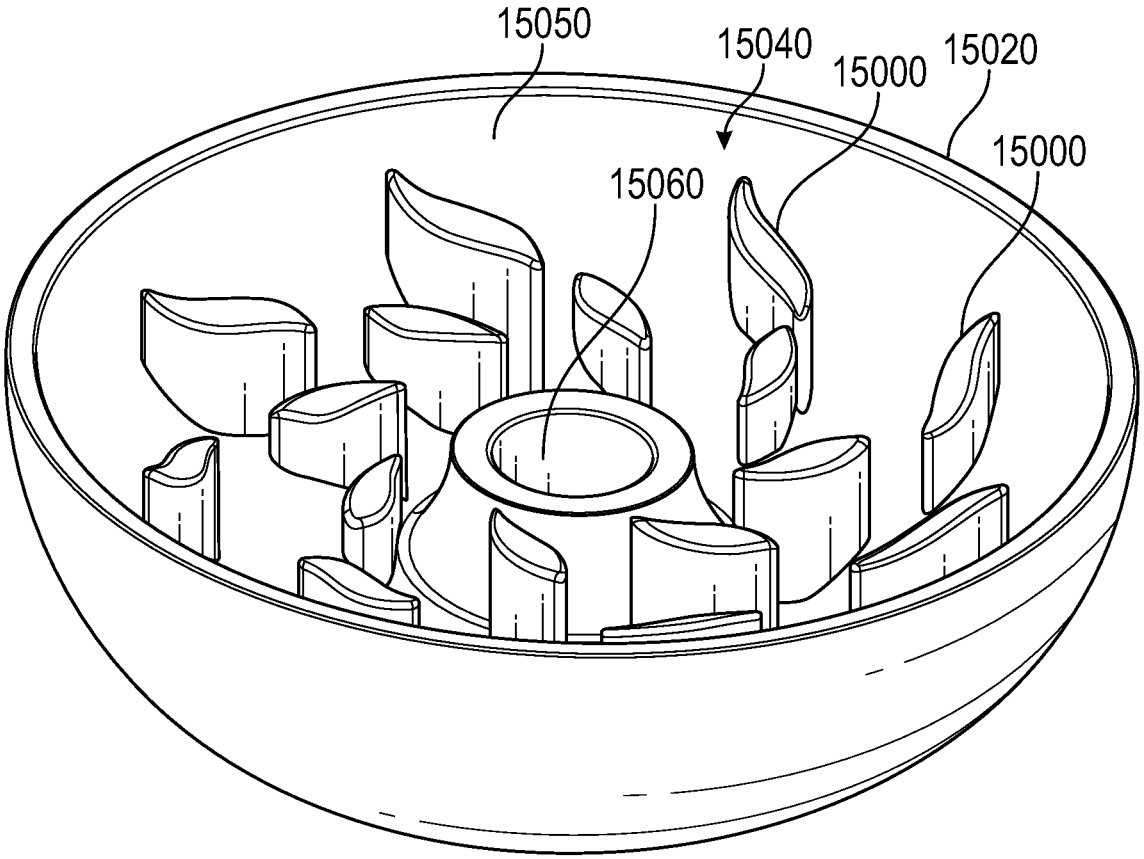
FIG. 15 is a perspective view of an additional embodiment of inserts in accordance with this disclosure.
Figure 16:
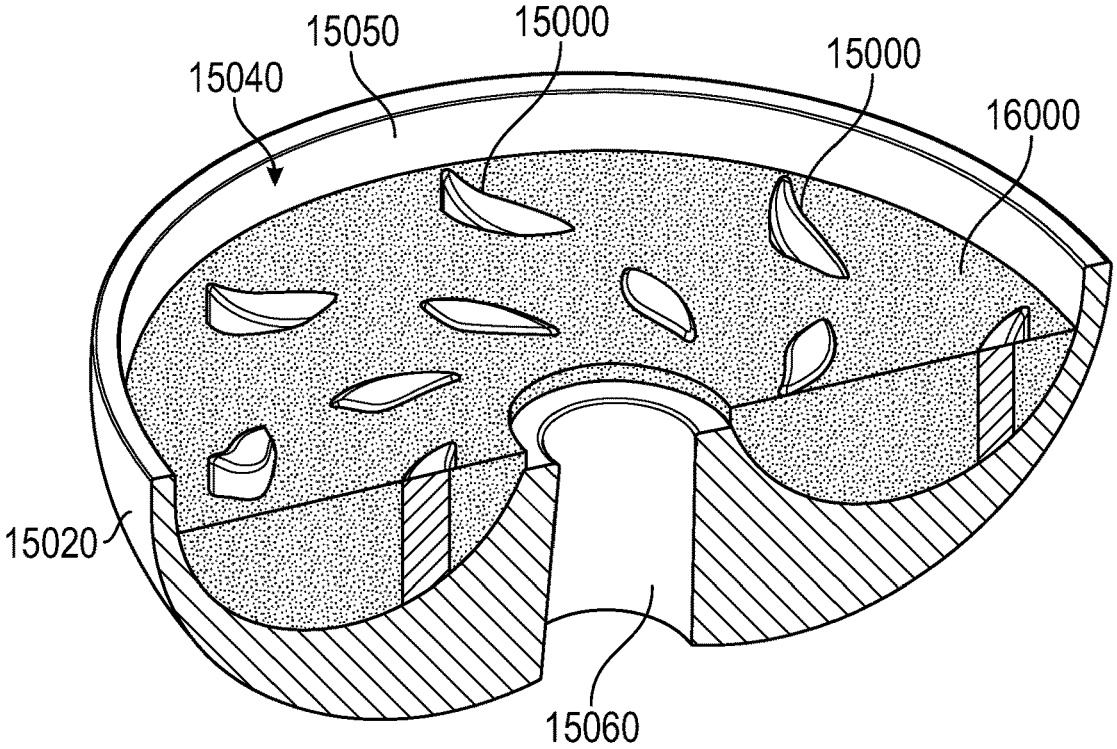
FIGS. 16 and 17 are sectioned perspective views of the embodiment of FIG. 15 shown with and without a smokable substance, respectively.
Figure 17:
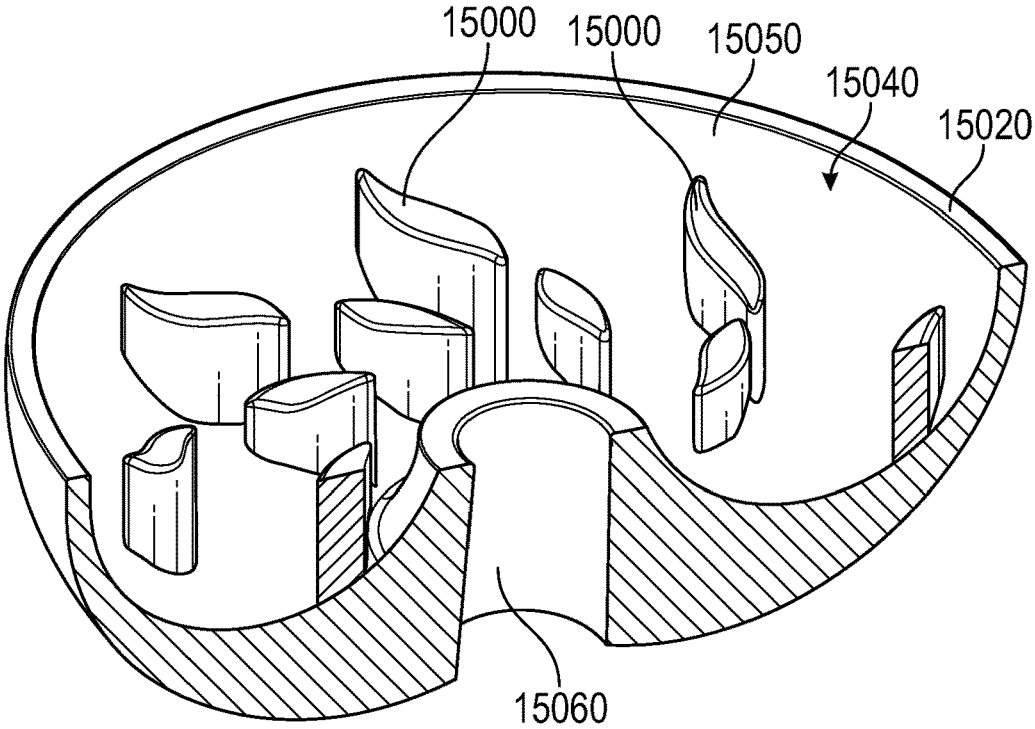
Figure 18:
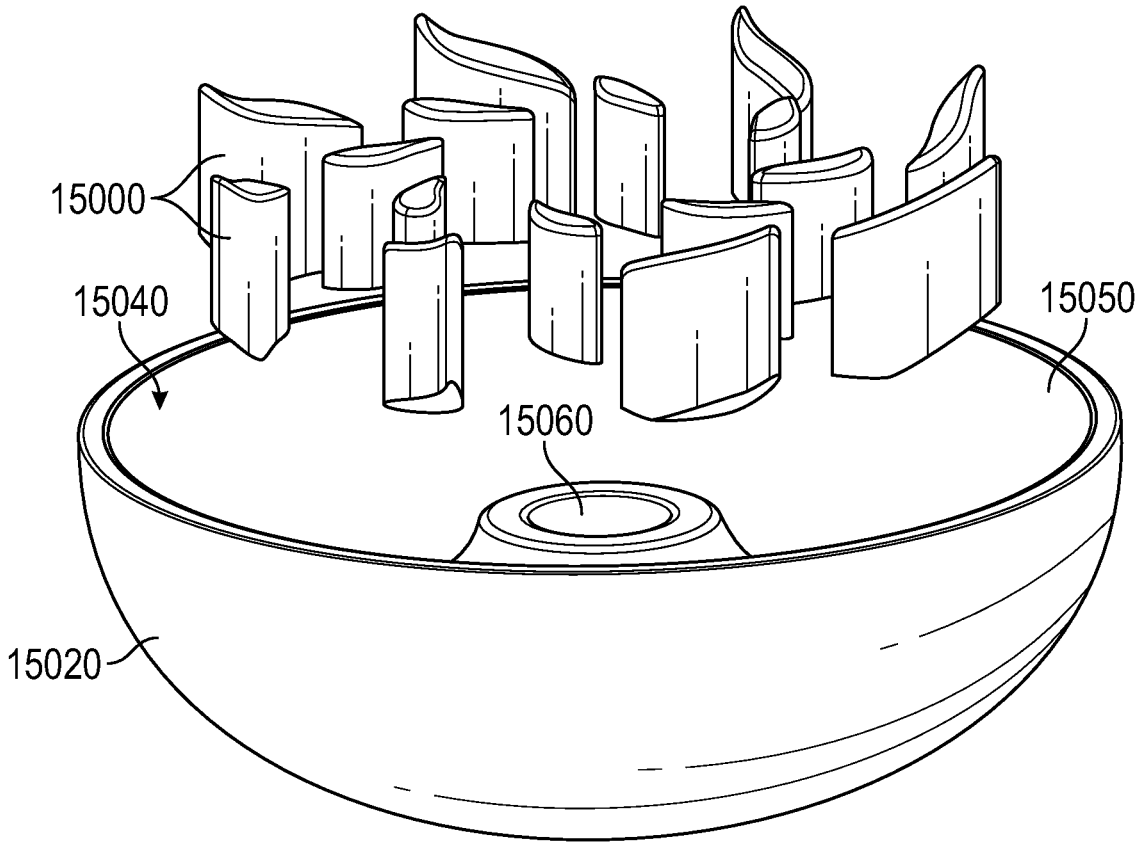
FIG. 18 is an exploded view of the embodiment of FIG. 15.

FIG. 15 is a perspective view of an additional embodiment of inserts 15000 in accordance with this disclosure. FIGS. 16 and 17 are sectioned perspective views of the embodiment of FIG. 15 shown with and without a smokable substance 16000, respectively. FIG. 18 is an exploded view of the embodiment of FIG. 15.

As shown, a substantially hemispherical bowl head 15020 is provided. In use, such a bowl head would extend vertically and radially from a substantially cylindrical bowl stalk, as discussed above with respect to other embodiments. The bowl head 15020 is then provided with an interior space 15040 defined by an inner surface 15050. The bowl head 15020 further has a hollow central pipe 15060 located centrally within the bowl head 15020 and forming a portion of the inner surface 15050. The hollow central pipe 15060 typically extends below the bowl head 15020 and through the bowl stalk. The stalk thereby encloses an extension of the central pipe 15060 for transmitting smoke from the interior space 15040.

In the embodiment shown, a plurality of inserts 15000 are provided, and each of the inserts 15000 are independent of each other and are not attached to the inner surface 15050. Instead, the inserts 15000 are typically rested on the inner surface 15050 or are embedded in a smokable substance 16000 within the bowl head 15020. The inserts 15000 may be vertically oriented and thereby similar to the vertical extensions 12060 discussed above with respect to FIG. 12. Further, while the inserts 15000 are shown as vertically oriented, they may take a variety of forms and have a variety of shapes and orientations.

In such embodiments, where the inserts 15000 are either removably fixed to the inner surface 15050 or are independent of and not attached to the inner surface, the vertical extensions may be inserted into the bowl head 15020 prior to or while packing the bowl with the smokable substance 1600, such as tobacco. Accordingly, a method may be provided for packing the hookah bowl head 15020 with the smokable substance 16000, where the method includes first packing the bowl with a first amount of the smokable substance and then inserting the inserts 15000.

In such an embodiment, after the inserts 15000 are located within the first amount of the smokable substance 16000 a user may continue to pack the bowl head 15020 with an additional amount of the smokable substance, such that the smokable substance at least partially encloses the inserts. Accordingly, the inserts 15000 may be initially located and partially supported by the first amount of the smokable substance 16000. Where the inserts 15000 are vertical extensions, and therefore have a vertical orientation, they may thereby be maintained vertically while continuing to back the bowl head 15020.

As discussed above, the inserts 15000 or the vertical extensions 12040 may be formed from a heat conductive material, and may thereby distribute heat such that the smokable substance is more evenly heated.

In the embodiment shown, the inserts 15000 are arranged radially about the hollow central pipe 15060 of the bowl head 15020. Accordingly, when locating the inserts 15000 within the smokable substance 1600, the inserts may be arrayed similarly.

While vertical extensions are described and shown, it will be understood that the inserts 15000 can take a variety of shapes, so long as they are at least partially enclosed by the smokable substance 16000 and thereby distribute heat evenly relative to the smokable substance.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A hookah bowl insert for evenly heating a smokable substance, the insert comprising:

a central core having at least one passageway extending therethrough; and a plurality of radial extensions extending in a radial direction from the central core for gripping the smokable substance therebetween, each radial extension comprising a vertical extension extending in a direction perpendicular to the radial direction, wherein the insert is constructed of a heat conductive material, wherein the central core is substantially planar, and the radial extensions are sloped relative to a first plane of the central core, such that the radial extensions extend to a second plane different than the first plane, and wherein the vertical extensions extend from the second plane to the first plane, and further comprising a connection segment circumferentially surrounding a planar segment of the central core and sloping from the first plane to the second plane.

2. The insert of claim 1, wherein a top of at least one of the vertical extensions extends above the first plane, such that a heat source having a planar lower surface rested on top of the vertical extensions would be suspended above the central core and would not contact the central core.

3. The insert of claim 1, further comprising at least one fixation element for fixing the connection segment to an interior surface of a hookah bowl.

4. The insert of claim 3 wherein the at least one fixation element is a plurality of protrusions for bracing the insert against a protruding pipe opening of the hookah bowl.

5. The insert of claim 1, wherein the central core is configured to be located above a pipe opening in a hookah bowl, such that the at least one passageway extending therethrough is aligned with the pipe opening.

6. The insert of claim 1, wherein the insert is a single piece.

7. A hookah bowl insert for evenly heating a smokable substance, the insert comprising:

a central core having a central axis and at least one passageway extending therethrough in the direction of the central axis; and a plurality of radial extensions extending in a radial direction from the central axis of the central core for gripping the smokable substance therebetween, each radial extension comprising a vertical extension extending in a direction parallel to the central axis, wherein the insert is constructed of a heat conductive material, and wherein each of the vertical extensions comprises a bulging profile, such that each vertical extension bulges towards an adjacent vertical extension of an adjacent radial extension such that the smokable substance, when inserted, is gripped between the vertical extension bulges of adjacent vertical extensions.

8. A hookah bowl insert for evenly heating a smokable substance, the insert comprising:

a central core having a central axis and at least one passageway extending therethrough in the direction of the central axis; and a plurality of radial extensions extending in a radial direction from the central axis of the central core for gripping the smokable substance therebetween, each radial extension comprising a vertical extension extending in a direction parallel to the central axis, wherein the insert is constructed of a heat conductive material, and wherein each vertical extension comprises a maximum width larger than a thickness of the insert at the central core.

9. A hookah bowl assembly for evenly heating a smokable substance, the hookah bowl assembly comprising:

a bowl head comprising:

an interior space defined by an inner surface;

a hollow central pipe; and a stalk below the central pipe, the stalk enclosing an extension of the central pipe for transmitting smoke from the interior space;

a bowl insert comprising:

a central core having a central axis and at least one passageway extending therethrough in the direction of the central axis; and a plurality of radial extensions extending in a radial direction from the central axis of the central core for gripping the smokable substance therebetween, each radial extension comprising a vertical extension having sidewalls extending in a direction parallel to the central axis;

wherein the insert is constructed of a heat conductive material,.

10. The assembly of claim 9, wherein the central core is substantially planar, and the radial extensions are sloped relative to a first plane of the central core, such that the radial extensions extend to a second plane different than the first plane, and wherein the vertical extensions extend from the second plane to the first plane.

11. The assembly of claim 9, wherein the central core is configured to be located above the hollow central pipe when inserted into the bowl head, such that the at least one passageway extending therethrough is aligned with the hollow central pipe.

12. The assembly of claim 9, wherein each of the vertical extensions has a a bulging profile, such that the profile of each vertical extension bulges towards an adjacent vertical extension of an adjacent radial extension such that the smokable substance, when inserted, is gripped between the vertical extension bulges of adjacent vertical extensions.

13. The assembly of claim 9, wherein the insert is permanently fixed to the inner surface of the bowl head.

14. The assembly of claim 9, wherein the insert is a single piece.

15. The assembly of claim 9, wherein each vertical extension has a maximum width larger than a thickness of the insert at the central core.

16. A hookah bowl assembly for evenly heating a smokable substance, the hookah bowl assembly comprising:

a bowl head comprising:

an interior space defined by an inner surface;

a hollow central pipe; and a stalk below the central pipe, the stalk enclosing an extension of the central pipe for transmitting smoke from the interior space;

a bowl insert comprising:

a central core having at least one passageway extending therethrough; and a plurality of radial extensions extending in a radial direction from the central core for gripping the smokable substance therebetween, each radial extension comprising a vertical extension extending in a direction perpendicular to the radial direction;

wherein the insert is constructed of a heat conductive material, wherein the central core is substantially planar, and the radial extensions are sloped relative to a first plane of the central core, such that the radial extensions extend to a second plane different than the first plane, and wherein the vertical extensions extend from the second plane to the first plane.

17. The assembly of claim 16, wherein a top of at least one of the vertical extensions extends above the first plane, such that a heat source having a planar lower surface rested on top of the vertical extensions would be suspended above the central core and would not contact the central core.

18. The assembly of claim 16, further comprising a connection segment circumferentially surrounding the central core and sloping from the first plane to the second plane.

19. The assembly of claim 18, wherein the hollow central pipe protrudes into the interior space of the bowl head, and the insert further comprises a plurality of protrusions for bracing the insert against the protruding hollow pipe.

20. A hookah bowl assembly for evenly heating a smokable substance, the hookah bowl assembly comprising:

a bowl head comprising:

an interior space defined by an inner surface;

a hollow central pipe; and a stalk below the central pipe, the stalk enclosing an extension of the central pipe for transmitting smoke from the interior space;

a bowl insert comprising:

a central core having at least one passageway extending therethrough; and a plurality of radial extensions extending in a radial direction from the central core for gripping the smokable substance therebetween, each radial extension comprising a vertical extension extending in a direction perpendicular to the radial direction;

wherein the insert is constructed of a heat conductive material, wherein each of the vertical extensions has bulging profile, such that the profile of each vertical extension bulges towards an adjacent vertical extension of an adjacent radial extension such that the smokable substance, when inserted, is gripped between the vertical extension bulges of adjacent vertical extensions.

* * * * *